US011993923B2

(12) United States Patent
Takaoka et al.

(10) Patent No.: US 11,993,923 B2
(45) Date of Patent: May 28, 2024

(54) SYSTEM AND METHOD FOR CONTROLLING WORK MACHINE

(71) Applicant: KOMATSU LTD., Tokyo (JP)

(72) Inventors: Yukihisa Takaoka, Tokyo (JP); Kota Beppu, Tokyo (JP); Yuto Fujii, Tokyo (JP); Toru Kurakane, Tokyo (JP)

(73) Assignee: KOMATSU LTD., Tokyo (JP)

( * ) Notice: Subject to any disclaimer, the term of this patent is extended or adjusted under 35 U.S.C. 154(b) by 333 days.

(21) Appl. No.: 17/598,958

(22) PCT Filed: May 20, 2020

(86) PCT No.: PCT/JP2020/019866
§ 371 (c)(1),
(2) Date: Sep. 28, 2021

(87) PCT Pub. No.: WO2020/255608
PCT Pub. Date: Dec. 24, 2020

(65) Prior Publication Data

US 2022/0195703 A1 Jun. 23, 2022

(30) Foreign Application Priority Data

Jun. 19, 2019 (JP) ..... 2019-113984

(51) Int. Cl.
*E02F 9/26* (2006.01)
*E02F 3/84* (2006.01)
*E02F 9/22* (2006.01)

(52) U.S. Cl.
CPC ..... *E02F 9/262* (2013.01); *E02F 9/265* (2013.01); *E02F 3/844* (2013.01); *E02F 9/2228* (2013.01); *E02F 9/2267* (2013.01)

(58) Field of Classification Search
CPC . E02F 9/262; E02F 9/265; E02F 3/844; E02F 9/2228; E02F 9/2267; E02F 3/841; E02F 9/2045; E02F 9/205; E02F 9/2296
See application file for complete search history.

(56) References Cited

U.S. PATENT DOCUMENTS 3,831,683 A * 8/1974 Ikeda ..... E02F 3/844 37/907
8,639,393 B2 1/2014 Taylor et al.
(Continued)

FOREIGN PATENT DOCUMENTS

AU 2019201404 A1 3/2019
JP 2018-197425 A 12/2018
(Continued)

OTHER PUBLICATIONS

The Examination report No. 1 for the Australian patent application No. 2020298366, issued on May 5, 2023.
(Continued)

*Primary Examiner* — Jason Holloway
*Assistant Examiner* — Madison B Emmett
(74) *Attorney, Agent, or Firm* — Global IP Counselors, LLP

(57) ABSTRACT

A controller is configured to determine a target excavation depth of a first pass based on a position of an excavation end, a target soil amount, and an excavation distance. The controller is configured to move a work implement to the target excavation depth of the first pass to execute an excavation of the first pass. The controller is configured to acquire an actual soil amount excavated in the first pass. The controller is configured to modify the target soil amount based on the actual soil amount. The controller is configured to determine the target excavation depth of a second pass based on the modified target soil amount. The controller is configured to
(Continued)

move the work implement to the target excavation depth of the second pass to execute the excavation of the second pass.

15 Claims, 8 Drawing Sheets

(56) References Cited

U.S. PATENT DOCUMENTS

| | | | | |
|---|---|---|---|---|
| 2015/0240453 | A1 | 8/2015 | Jaliwala et al. | |
| 2016/0076223 | A1 | 3/2016 | Wei et al. | |
| 2016/0077513 | A1* | 3/2016 | Wei | E01C 19/004 700/114 |
| 2016/0258129 | A1* | 9/2016 | Wei | E02F 3/841 |
| 2017/0002540 | A1 | 1/2017 | Fletcher et al. | |
| 2018/0163376 | A1* | 6/2018 | Redenbo | E02F 9/262 |
| 2018/0245308 | A1 | 8/2018 | Ready-Campbell et al. | |
| 2019/0194912 | A1 | 6/2019 | Ishibashi et al. | |
| 2019/0352886 | A1* | 11/2019 | Harada | E02F 3/847 |
| 2020/0056353 | A1 | 2/2020 | Ishibashi et al. | |
| 2021/0148090 | A1 | 5/2021 | Hashimoto | |
| 2022/0268000 | A1* | 8/2022 | Song | E02F 9/264 |

FOREIGN PATENT DOCUMENTS

| | | | |
|---|---|---|---|
| JP | 2019-39278 | A | 3/2019 |
| WO | 2018/084030 | A1 | 5/2018 |

OTHER PUBLICATIONS

The International Search Report for the corresponding international application No. PCT/JP2020/019866, issued on Aug. 18, 2020.

* cited by examiner

SYSTEM AND METHOD FOR CONTROLLING WORK MACHINE

CROSS-REFERENCE TO RELATED APPLICATIONS

This application is a U.S. National stage application of International Application No. PCT/JP2020/019866, filed on May 20, 2020. This U.S. National stage application claims priority under 35 U. S. C. § 119(a) to Japanese Patent Application No. 2019-113984, filed in Japan on Jun. 19, 2019, the entire contents of which are hereby incorporated herein by reference.

BACKGROUND

Field of the Invention

The present disclosure relates to a system and a method for controlling a work machine.

Background Information

Conventionally, a system that automatically controls a work machine is known. For example, in the system of U.S. Pat. No. 8,639,393, the controller presets a target profile for the work implement at the work site from the terrain of the work site. The controller starts excavation from the starting position on the current terrain of the work site and moves the work implement according to the target profile.

SUMMARY

Factors, such as terrain, soil quality, or soil hardness, can cause the work implement to deviate from the target profile before reaching the target end position. In that case, if the work is continued as it is, unevenness will be created on the terrain, and the work efficiency will decrease.

An object of the present disclosure is to suppress a decrease in work efficiency due to a factor, such as soil hardness, in automatic control of a work machine.

A system according to a first aspect is a system for controlling a work machine including a work implement. The system includes a controller. The controller acquires a position of an excavation end by the work machine, a target soil amount, and an excavation distance. The controller determines a target excavation depth of a first pass based on the position of the excavation end, the target soil amount, and the excavation distance. The controller moves the work implement to the target excavation depth of the first pass to execute an excavation of the first pass. The controller acquires an actual soil amount excavated in the first pass. The controller modifies the target soil amount based on the actual soil amount. The controller determines the target excavation depth of a second pass based on the modified target soil amount. The controller moves the work implement to the target excavation depth of the second pass to execute the excavation of the second pass.

A method according to a second aspect is a method performed by a controller to control a work machine including a work implement. The method includes the following processing. A first process is to acquire a position of an excavation end by the work machine, a target soil amount, and an excavation distance. A second process is to determine a target excavation depth of a first pass based on the position of the excavation end, the target soil amount, and the excavation distance. A third process is to move the work implement to the target excavation depth of the first pass to execute an excavation of the first pass. A fourth process is to acquire an actual soil amount excavated in the first pass. A fifth process is to modify the target soil amount based on the actual soil amount. A sixth process is to determine the target excavation depth of a second pass based on the modified target soil amount. A seventh process is to move the work implement to the target excavation depth of the second pass to execute the excavation of the second pass.

A system according to a third aspect is a system for controlling a work machine including a work implement. The system includes a controller. The controller acquires a position of an excavation end by the work machine, a target soil amount, and an excavation distance. The controller determines a target excavation depth of a first pass based on the position of the excavation end, the target soil amount, and the excavation distance. The controller moves the work implement to the target excavation depth of the first pass to execute an excavation of the first pass.

According to the present disclosure, in the automatic control of the work machine, it is possible to suppress a decrease in work efficiency due to a factor, such as soil hardness.

DESCRIPTION OF EMBODIMENTS

Figure 1:
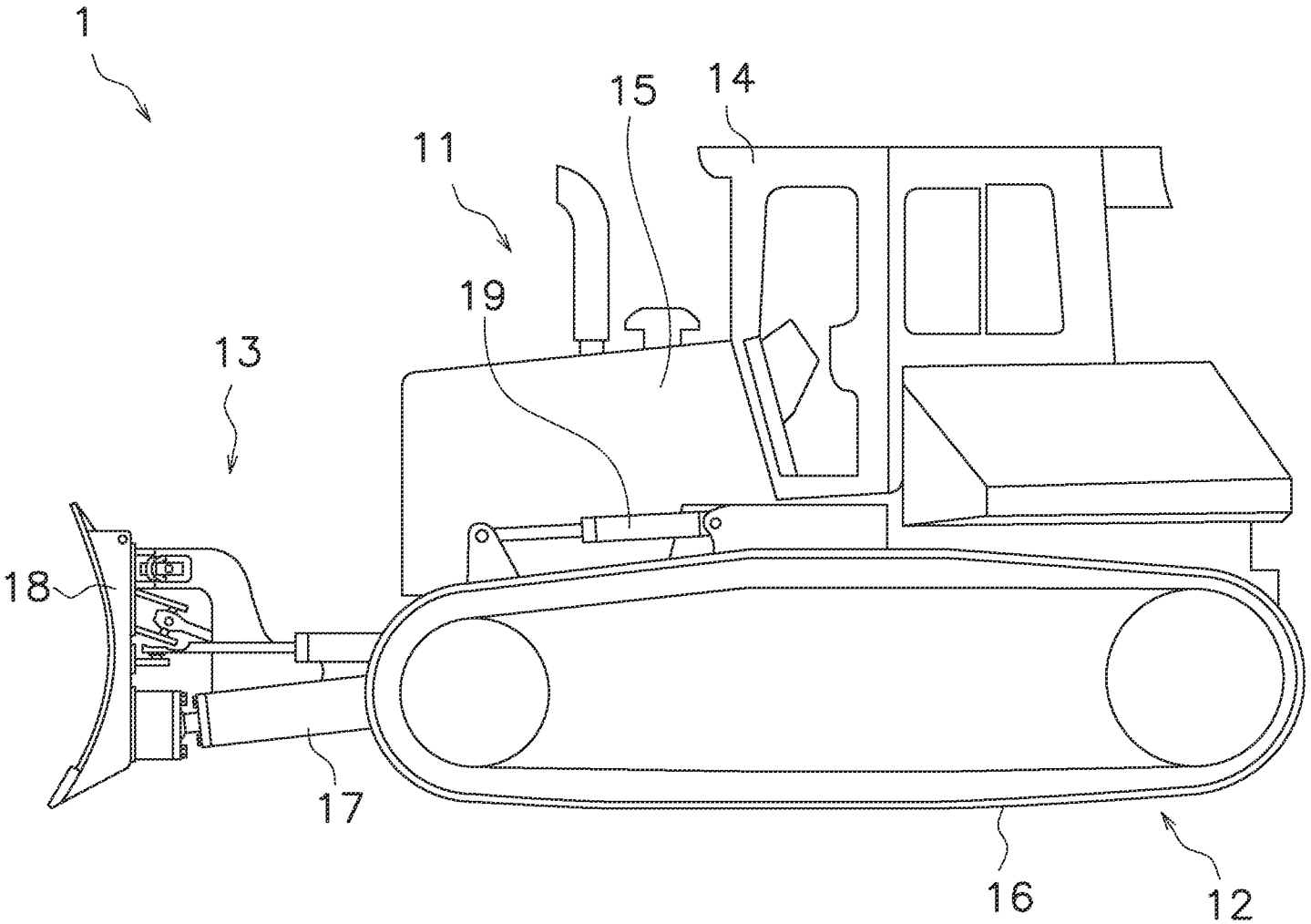
FIG. 1 is a side view showing a work machine according to an embodiment.

Hereinafter, a work machine 1 according to an embodiment will be described with reference to the drawings. FIG. 1 is a side view showing the work machine 1 according to the embodiment. The work machine 1 according to the present embodiment is a bulldozer. The work machine 1 includes a vehicle body 11, a traveling device 12, and a work implement 13.

The vehicle body 11 includes a cab 14 and an engine compartment 15. An operator's seat (not illustrated) is disposed in the cab 14. The traveling device 12 is attached to the vehicle body 11. The traveling device 12 includes left and right crawler tracks 16. In FIG. 1, only the left crawler track 16 is illustrated. The work machine 1 runs by rotating the crawler tracks 16.

The work implement 13 is attached to the vehicle body 11. The work implement 13 includes a lift frame 17, a blade 18, and a lift cylinder 19. The lift frame 17 is attached to the vehicle body 11 so as to be movable up and down. The lift frame 17 supports the blade 18. The blade 18 moves up and down with the operation of the lift frame 17. The lift frame 17 may be attached to the traveling device 12. The lift cylinder 19 is connected to the vehicle body 11 and the lift frame 17. As the lift cylinder 19 expands and contracts, the lift frame 17 moves up and down.

Figure 2:
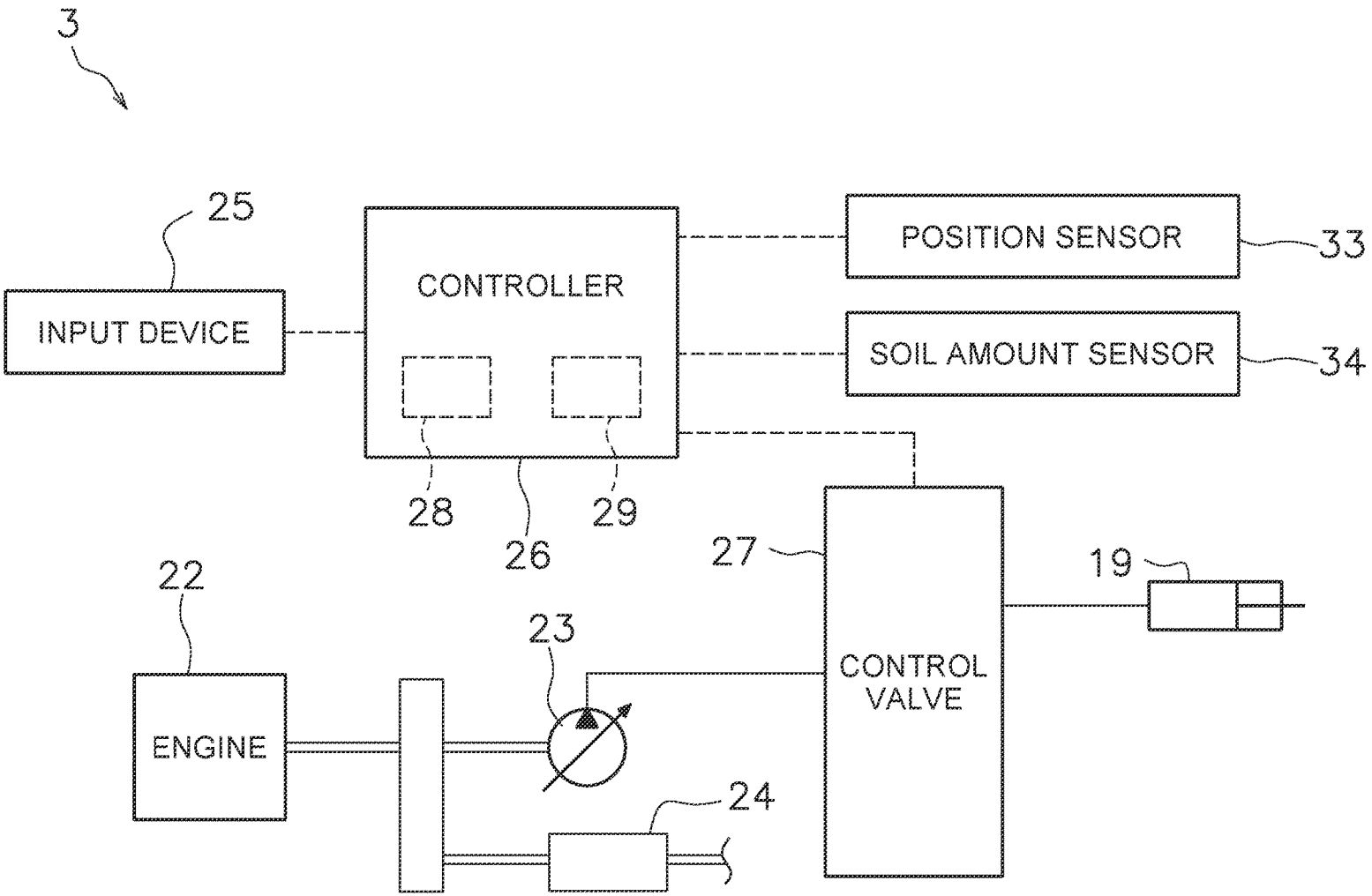
FIG. 2 is a block diagram showing a structure of a control system for the work machine.

FIG. 2 is a block diagram showing a configuration of a control system 3 for the work machine 1. In this embodiment, the control system 3 is installed in the work machine 1. As illustrated in FIG. 2, the work machine 1 includes an engine 22, a hydraulic pump 23, and a power transmission device 24. The hydraulic pump 23 is driven by the engine 22 to discharge hydraulic fluid. The hydraulic fluid discharged from the hydraulic pump 23 is supplied to the lift cylinder 19. Although one hydraulic pump 23 is illustrated in FIG. 2, a plurality of hydraulic pumps may be provided.

The power transmission device 24 transmits the driving force of the engine 22 to the traveling device 12. The power transmission device 24 may be, for example, an HST (Hydro Static Transmission). Alternatively, the power transmission device 24 may be, for example, a transmission including a torque converter or a plurality of speed gears.

The control system 3 includes an input device 25, a controller 26, and a control valve 27. The input device 25 is disposed in the cab 14. The input device 25 is operable by an operator. The input device 25 outputs an operation signal corresponding to the operation by the operator. The input device 25 outputs the operation signal to the controller 26.

The input device 25 includes an operation member, such as an operation lever, a pedal, or a switch, for operating the traveling device 12 and the work implement 13. The input device 25 may include a touch screen. In response to the operation of the input device 25, the travel of the work machine 1, such as forward movement and reverse movement, is controlled. Operations, such as ascending and descending, of the work implement 13 are controlled according to the operation of the input device 25.

The controller 26 is programmed to control the work machine 1 based on acquired data. The controller 26 includes a storage device 28 and a processor 29. The storage device 28 includes a non-volatile memory, such as ROM, and a volatile memory, such as RAM. The storage device 28 may include an auxiliary storage device, such as a hard disk or an SSD (Solid State Drive). The storage device 28 is an example of a non-transitory computer-readable recording medium. The storage device 28 stores computer commands and data for controlling the work machine 1.

The processor 29 is, for example, a CPU (central processing unit). The processor 29 executes a process for controlling the work machine 1 according to the program. The controller 26 runs the work machine 1 by controlling the traveling device 12 or the power transmission device 24. The controller 26 moves the blade 18 up and down by controlling the control valve 27.

The control valve 27 is a proportional control valve and is controlled by a command signal from the controller 26. The control valve 27 is disposed between the hydraulic pump 23 and the hydraulic actuator such as the lift cylinder 19. The control valve 27 controls the flow rate of the hydraulic fluid supplied from the hydraulic pump 23 to the lift cylinder 19. The controller 26 generates a command signal to the control valve 27 to operate the blade 18. As a result, the lift cylinder 19 is controlled. The control valve 27 may be a pressure proportional control valve. Alternatively, the control valve 27 may be an electromagnetic proportional control valve.

As illustrated in FIG. 2, the control system 3 includes a position sensor 33. The position sensor 33 includes a GNSS (Global Navigation Satellite System) receiver, such as GPS (Global Positioning System). The position sensor 33 receives a positioning signal from a satellite and acquires a current position of the work machine 1 from the positioning signal. The controller 26 calculates a tip position of the blade 18 from the current position of the work machine 1.

Figure 3:
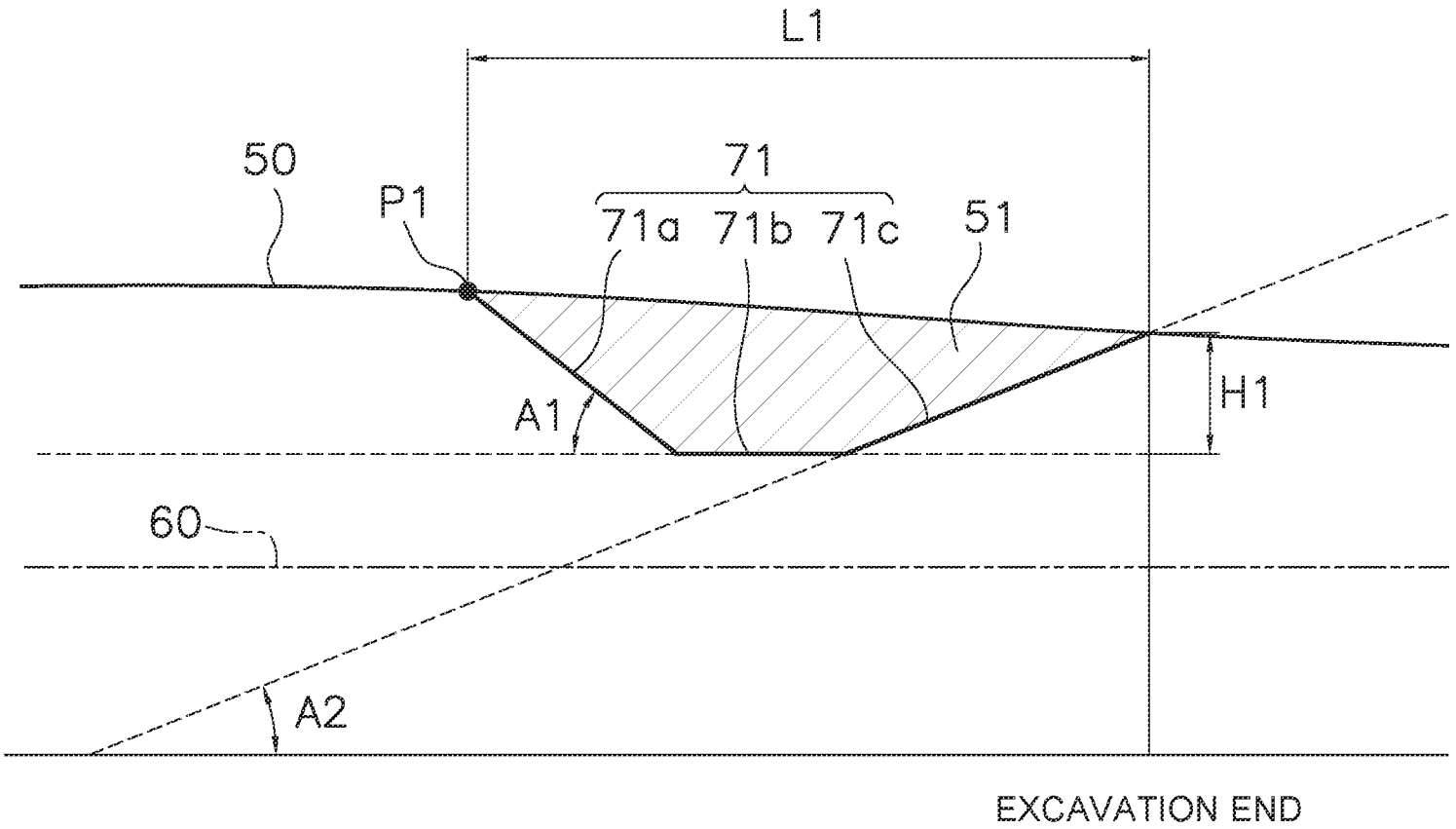
FIG. 3 is a side view showing an example of a current terrain.

The controller 26 acquires current terrain data. The current terrain data indicates a current terrain of the work site. The current terrain data indicates a three-dimensional survey map of the current terrain. FIG. 3 is a side view showing an example of the current terrain 50. The current terrain data indicates the coordinates and altitudes of a plurality of points on the current terrain 50.

The initial current terrain data is stored in the storage device 28 in advance. For example, the initial current terrain data may be acquired by laser surveying. The controller 26 acquires the latest current terrain data and updates the current terrain data while the work machine 1 is moving. Specifically, the controller 26 acquires the heights of a plurality of points on the current terrain 50 through which the crawler track 16 has passed. Alternatively, the controller 26 may acquire the latest current terrain data from a device outside the work machine 1.

The control system 3 includes a soil amount sensor 34. The soil amount sensor 34 detects an actual soil amount held by the blade 18. The controller 26 acquires soil amount data indicative of the actual soil amount from the soil amount sensor 34. The soil amount sensor 34 may be, for example, a hydraulic pressure sensor that detects the load received by the blade 18. The controller 26 may calculate the actual soil amount from the load received by the blade 18. Alternatively, the soil amount sensor 34 may be a scanning device, such as a Lidar (light detection and ranging) device or a camera. The controller 26 may calculate the actual soil amount from the shape or the image of the soil held by the blade 18. Alternatively, the controller 26 may calculate the actual soil amount from the current terrain 50 before excavation and the trajectory of the tip of the blade 18 during excavation.

Figure 4:
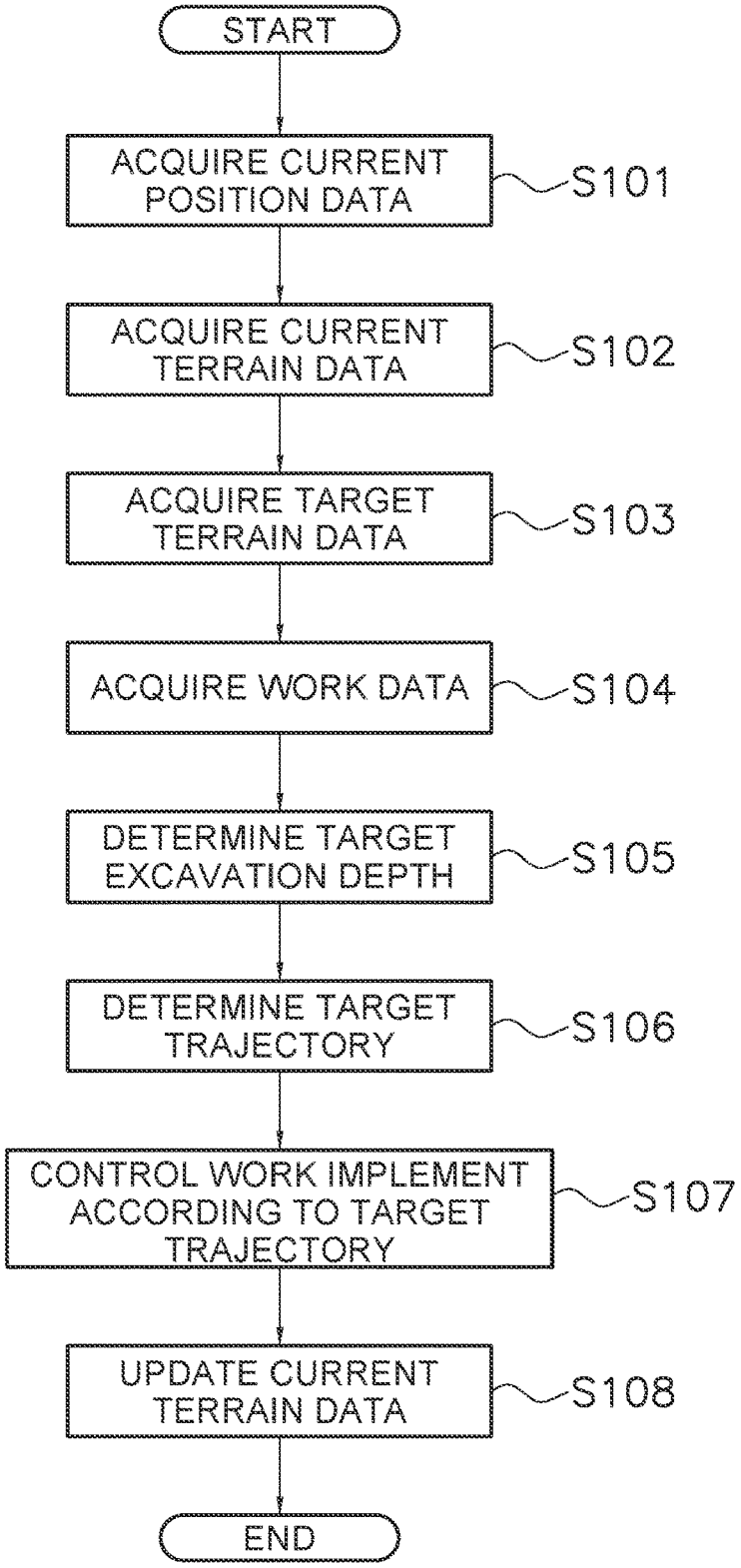
FIG. 4 is a flowchart showing a process of automatic control for the work machine for a first pass.
Figure 5:
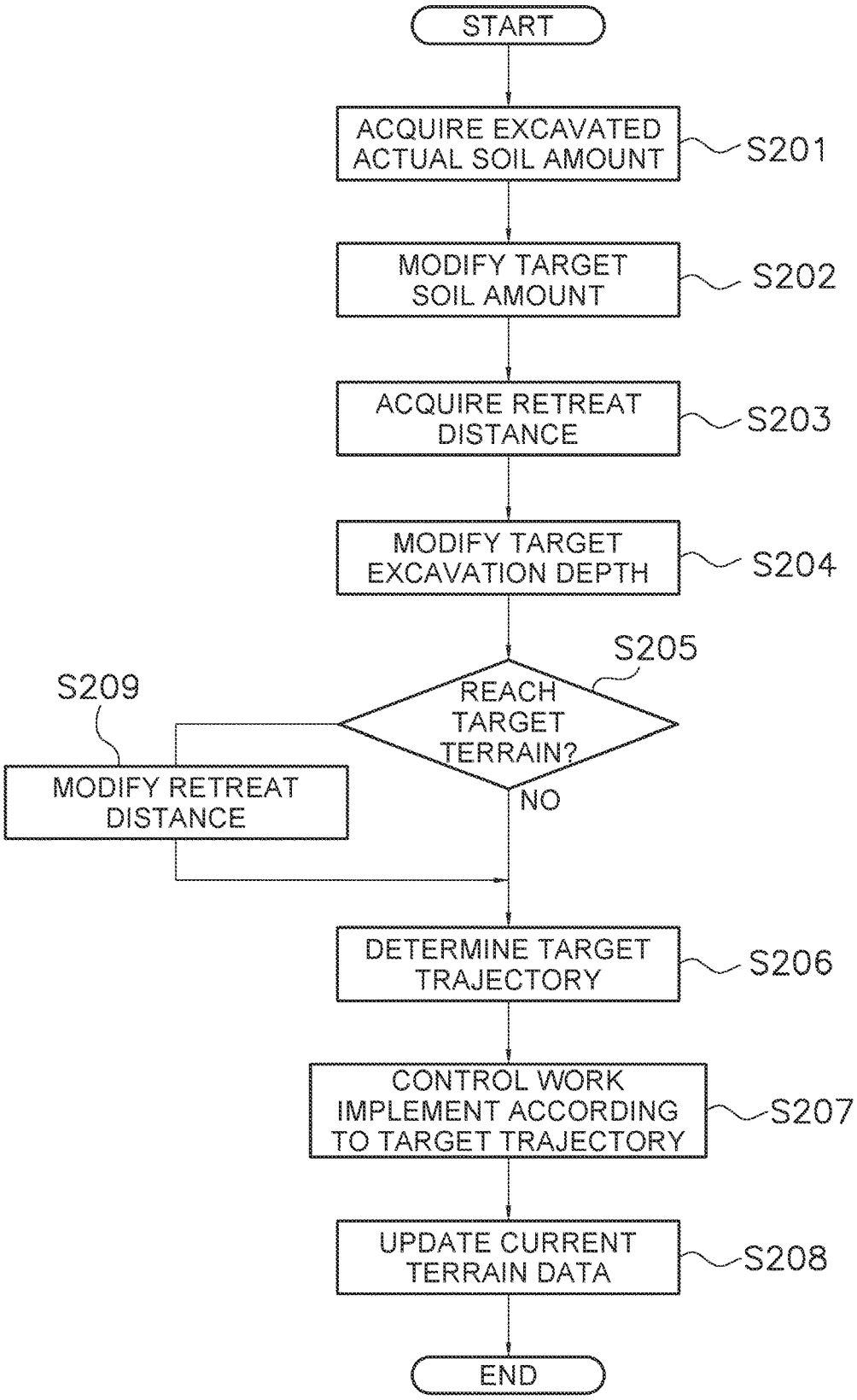
FIG. 5 is a flowchart showing the process of the automatic control for the work machine after a first pass.

Next, the automatic control of the work machine 1 executed by the controller 26 will be described. The automatic control of the work machine 1 may be a semi-automatic control performed in combination with a manual operation by the operator. Alternatively, the automatic control of the work machine 1 may be a fully automatic control performed without manual operation by the operator. In the following description, it is assumed that the work machine 1 excavates each slot by going back and forth between each slot in slot dosing, for example. FIGS. 4 and 5 are flowcharts showing the process of the automatic control of the work machine 1.

As illustrated in FIG. 4, in step S101, the controller 26 acquires the current position data. The current position data indicates the current tip position of the blade 18. In step S102, the controller 26 acquires the current terrain data.

In step S103, the controller 26 acquires target terrain data. As illustrated in FIG. 3, the target terrain data shows a target terrain 60 of the work by the work machine 1. The target terrain 60 is a target profile of the terrain to be worked, and shows a desired shape as a result of excavation work. The target terrain data shows a lower limit value of a target excavation depth for excavation. At least part of the target terrain 60 is located below the current terrain 50. The target terrain data may be generated by the operation of the input device 25 by the operator. Alternatively, the target terrain data may be automatically generated by the controller 26 based on the current terrain data. In FIG. 3, the target terrain 60 is horizontal. However, the target terrain 60 may be inclined with respect to the horizontal direction.

In step S104, the controller 26 acquires work data. The work data includes a position of an excavation end by the work machine 1, a target soil amount, an excavation distance L1, an angle A1 of an approach path, and an angle A2 of an exit path. The target soil amount indicates a target amount of soil excavated by the blade 18 in one pass. One pass means a series of operations from the start of excavation by moving the work machine 1 forward to the end of the excavation by switching to reverse.

As illustrated in FIG. 3, the excavation distance L1 indicates a distance between a first start position P1 and the excavation end. The first start position P1 is a start position of excavation of the first pass. The controller 26 may acquire the work data by operating the input device 25 by the operator. Alternatively, the controller 26 may acquire the work data from an external computer that manages the construction at the work site. Alternatively, the controller 26 may automatically determine the work data.

In step S105, the controller 26 determines the target excavation depth H1 of the first pass based on the work data. The controller 26 determines the target excavation depth H1 of the first pass so that the excavated soil amount predicted based on the work data matches the target soil amount. The hatched part 51 (hereinafter referred to as "first cut Si") in FIG. 3 corresponds to the predicted amount of excavated soil. The controller 26 determines the target excavation depth H1 of the first pass so that a target trajectory 71 of the first pass, which will be described later, does not exceed the target terrain 60 downward.

In step S106, the controller 26 determines the target trajectory 71 of the first pass. As illustrated in FIG. 3, the target trajectory 71 of the first pass includes an approach path 71*a*, an intermediate path 71*b*, and an exit path 71*c*. The approach path 71*a* extends from the first start position P1 at the angle A1. The exit path 71*c* extends at the angle A2 toward the position of the excavation end. The intermediate path 71*b* is located between the approach path 71*a* and the exit path 71*c*. In the example illustrated in FIG. 3, the intermediate path 71*b* is horizontal. However, the intermediate path 71*b* may be inclined with respect to the horizontal direction.

The controller 26 determines the target trajectory 71 of the work implement 13 in the first pass based on the position of the excavation end, the excavation distance L1, the angle A1 of the approach path 71*a*, the angle A2 of the exit path 71*c*, and the target excavation depth H1 of the first pass. The controller 26 determines the first start position P1 from the position of the excavation end and the excavation distance L1. The controller 26 determines the target trajectory 71 of the first pass from the first start position P1, the angle A1 of the approach path 71*a*, the angle A2 of the exit path 71*c*, and the target excavation depth H1 of the first pass. At least a part of the target trajectory 71 of the first pass is located below the current terrain 50.

In step S107, the controller 26 controls the blade 18 according to the target trajectory 71 of the first pass. The controller 26 starts the work by the work implement 13 from the start position of excavation, and controls the work implement 13 to move the tip of the blade 18 according to the target trajectory 71 of the first pass. For example, as illustrated in FIG. 3, the controller 26 moves the tip of the blade 18 from the first start position P1 toward the target trajectory 71 of the first pass, and moves along the target trajectory 71 of the first pass. As a result, the blade 18 moves to the target excavation depth H1 of the first pass, and the first cut 51 is excavated. The controller 26 moves the tip of the blade 18 to a soil placement range beyond the excavation end. As a result, the excavated soil is discharged from the blade 18 in the soil placement range.

In excavation, the tip of the blade 18 does not always move along the target trajectory 71. For example, when the load on the blade 18 becomes excessive due to factors such as hard soil, the tip of the blade 18 may separate from the target trajectory 71. When the tip of the blade 18 deviates from the target trajectory 71 during the excavation of the previous pass, a difference occurs between the target soil amount and the actual soil amount.

In step S108, the controller 26 updates the current terrain data. The current terrain 50 may be updated at any time. When the excavation of the first pass is completed, the work machine 1 retreats and moves to a second start position P2. Then, the work machine 1 starts excavation of the second pass from the second start position P2.

FIG. 5 is a flowchart showing the excavation process after the first pass. As illustrated in FIG. 5, in step S201, the controller 26 acquires the actual soil amount excavated in the previous pass.

In step S202, the controller 26 modifies the target soil amount based on the actual soil amount. In step S202, the controller 26 calculates a difference between the initial target soil amount and the actual soil amount. The controller 26 modifies the target soil amount based on the difference. For example, the controller 26 modifies the target soil amount by subtracting the value acquired by multiplying the difference by a predetermined coefficient from the initial target soil amount. Alternatively, the controller 26 may set the actual soil amount as the target soil amount.

In step S203, the controller 26 acquires a retreat distance. The retreat distance indicates a distance from the start position of excavation of the previous pass to the start position of excavation of the next pass, or a distance from the position of the excavation end to the first start position P1. The controller 26 may acquire the retreat distance by operating the input device 25 by the operator. Alternatively, the controller 26 may acquire the retreat distance from an external computer that manages the construction of the work site. Alternatively, the controller 26 may automatically determine the retreat distance.

In step S204, the controller 26 modifies the target excavation depth based on the modified target soil amount. The controller 26 modifies the target excavation depth based on the modified target soil amount, the retreat distance, and the angle A1 of the approach path. For example, FIG. 6 is a diagram showing an example of the current terrain 50 at the start of excavation of the second pass.

Figure 6:
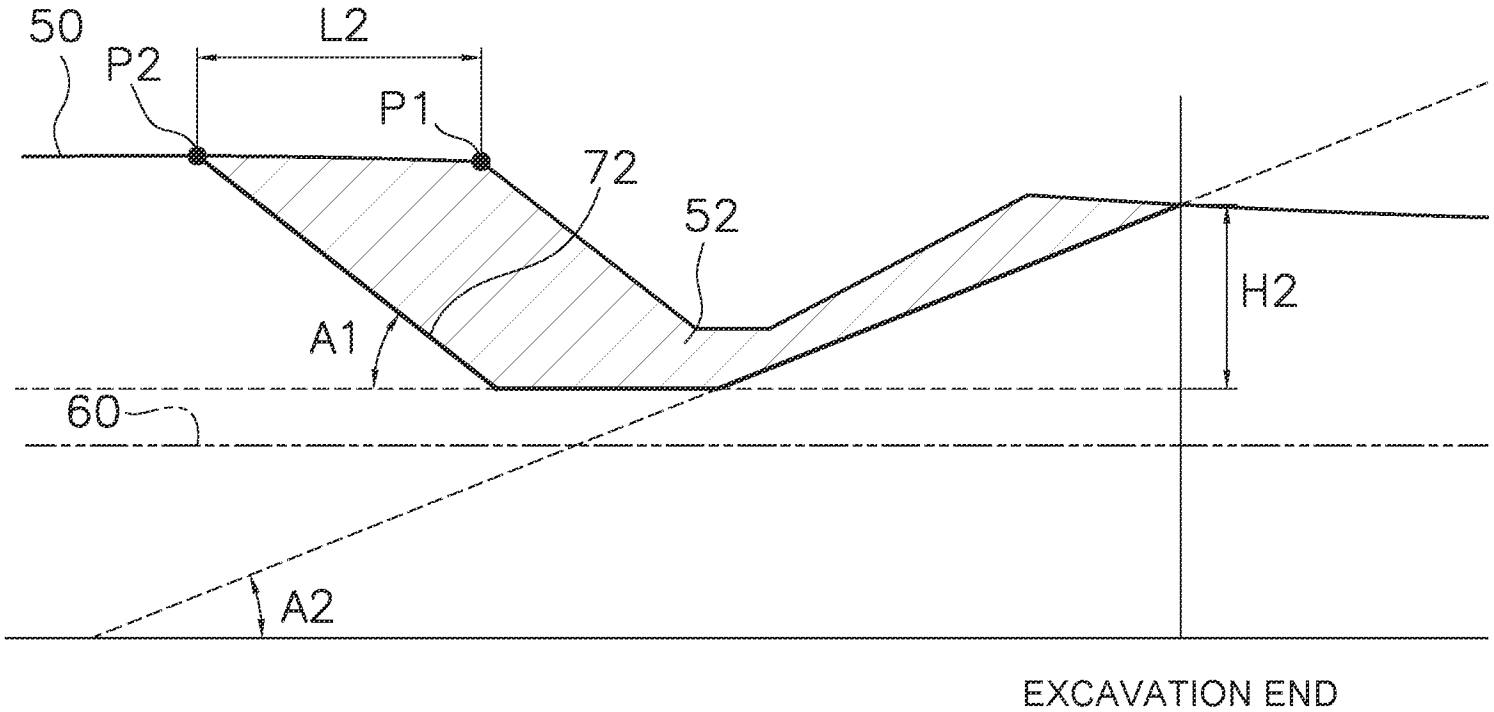
FIG. 6 is a diagram showing an example of the current terrain at a start of an excavation of a second pass.

As illustrated in FIG. 6, the controller 26 determines the target excavation depth H2 of the second pass based on the modified target soil amount. The controller 26 determines the target excavation depth H2 of the second pass so that the excavated soil amount predicted based on the work data matches the modified target soil amount. The hatched part 52 (hereinafter referred to as "second cut 52") in FIG. 6 corresponds to the predicted amount of excavated soil. The controller 26 determines the target excavation depth H2 of the second pass so that the target trajectory 72 of the second pass, which will be described later, does not exceed the target terrain 60 downward.

In step S205, the controller 26 determines whether the modified target excavation depth has reached the target terrain 60. For example, in FIG. 6, the target excavation depth H2 of the second pass has not reached the target terrain 60. In that case, the process proceeds to step S206.

In step S206, the controller 26 determines the target trajectory for the next pass. The controller 26 determines the target trajectory of the next pass based on the start position of excavation of the previous pass, the position of the excavation end, the retreat distance, the angle A1 of the approach path, the angle A2 of the exit path, and the modified target excavation depth. As illustrated in FIG. 6, the controller 26 determines the second start position P2 from the first start position P1 and the retreat distance L2. The second start position P2 is a start position of excavation of the second pass. The controller 26 determines the target trajectory 72 of the second pass based on the second start position P2, the position of the excavation end, the angle A1 of the approach path, the angle A2 of the exit path, and the modified target excavation depth H2.

In step S207, the controller 26 controls the work implement 13 according to the target trajectory determined in step S206. As illustrated in FIG. 6, the controller 26 controls the work implement 13 according to the target trajectory 72 of the second pass. As a result, the blade 18 moves to the target excavation depth H2 of the second pass, and the second cut 52 is excavated. In step S208, the controller 26 updates the current terrain data as in step S108.

When the modified target excavation depth reaches the target terrain 60 in step S205, the process proceeds to step S209. In step S209, the controller 26 modifies the retreat distance based on the modified target soil amount. The controller 26 modifies the retreat distance so that the excavated soil amount predicted based on the work data matches the modified target soil amount.

Figure 7:
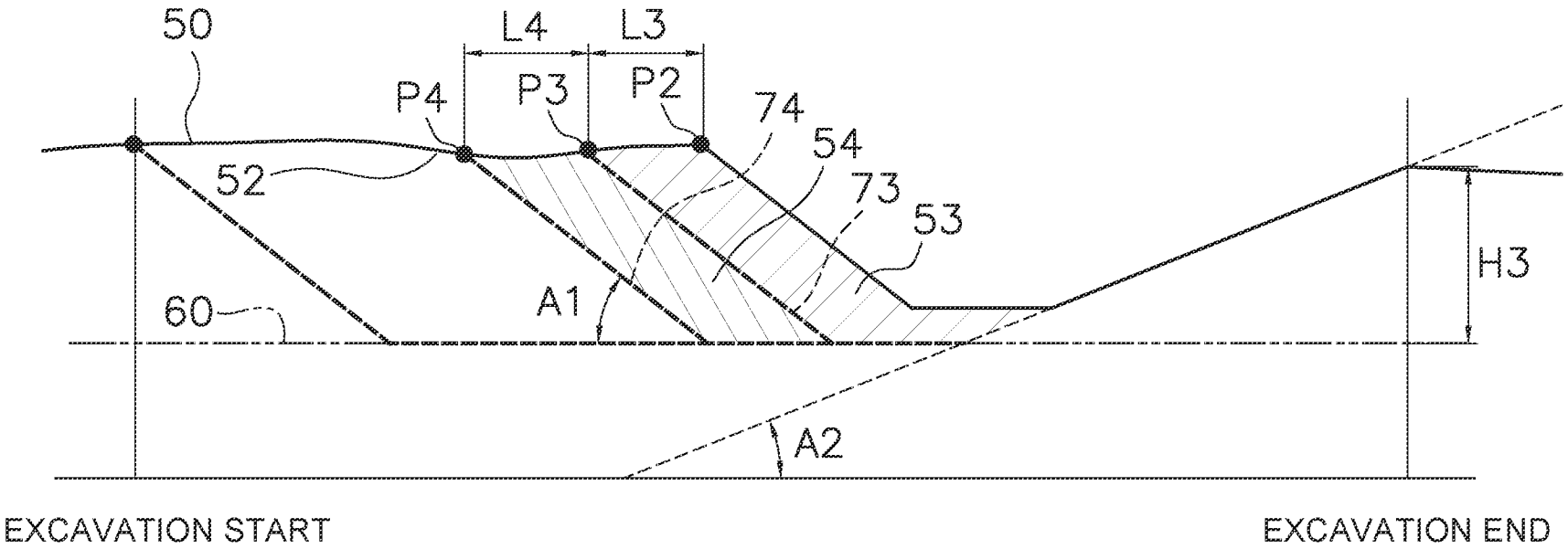
FIG. 7 is a diagram showing an example of the current terrain at a start of an excavation of a third pass.

For example, FIG. 7 is a diagram showing the current terrain 50 at the start of excavation of the third pass. As illustrated in FIG. 7, the target excavation depth H3 of the third pass has reached the target terrain 60. In this case, the controller 26 determines the retreat distance L3 of the third pass based on the modified target soil amount. The controller 26 determines the retreat distance L3 of the third pass so that the excavated soil amount predicted based on the work data matches the modified target soil amount. The hatched part 53 (hereinafter referred to as "third cut 53") in FIG. 7 corresponds to the excavated soil amount predicted in the third pass.

The controller 26 determines the third start position P3 from the second start position P2 and the modified retreat distance L3. The third start position P3 is a start position of excavation of the third pass. The controller 26 determines the target trajectory 73 of the third pass from the position of the third start position P3, the position of the excavation end, the angle A1 of the approach path, the angle A2 of the exit path, and the target excavation depth H3. The controller 26 controls the work implement 13 according to the target trajectory 73 of the third pass. As a result, as illustrated in FIG. 7, the third cut 53 is excavated.

Regarding the excavation of the fourth pass, as in the third pass, the controller 26 modifies the target soil amount and determines the retreat distance L4 of the fourth pass based on the modified target soil amount. The controller 26 determines the retreat distance L4 of the fourth pass so that the excavated soil amount predicted based on the work data matches the modified target soil amount. The hatched part 54 (hereinafter referred to as "fourth cut 54") in FIG. 7 corresponds to the excavated soil amount predicted in the fourth pass.

The controller 26 determines the fourth start position P4 from the third start position P3 and the modified retreat distance L4. The controller 26 determines the target trajectory 74 of the fourth pass from the position of the fourth start position P4, the position of the excavation end, the angle A1 of the approach path, the angle A2 of the exit path, and the target excavation depth H3. The controller 26 controls the work implement 13 according to the target trajectory 74 of the fourth pass. As a result, as illustrated in FIG. 7, the fourth cut 54 is excavated.

By repeating the above work, the current terrain 50 is excavated so as to approach the target terrain 60. Further, when the excavation of one target terrain 60 is completed, the controller 26 performs the same work as described above for the next target terrain located further below.

In the control system 3 of the work machine 1 according to the present embodiment described above, the target soil amount is modified based on the actual soil amount, and the target excavation depth of the next pass is determined based on the modified target soil amount. As a result, in the automatic control of the work machine 1, it is possible to suppress a decrease in work efficiency due to factors such as soil hardness.

Although one embodiment of the present invention has been described above, the present invention is not limited to the above embodiment, and various modifications can be made without departing from the gist of the invention.

The work machine 1 is not limited to a bulldozer, and may be another vehicle, such as a wheel loader, a motor grader, or a hydraulic excavator. The work machine 1 may be a vehicle driven by an electric motor.

The controller 26 may have a plurality of controllers that are separate from each other. The processing by the controller 26 may be distributed to a plurality of controllers and executed by the plurality of controllers. The above-mentioned processing may be distributed to a plurality of processors and executed by the plurality of processors.

Figure 8:
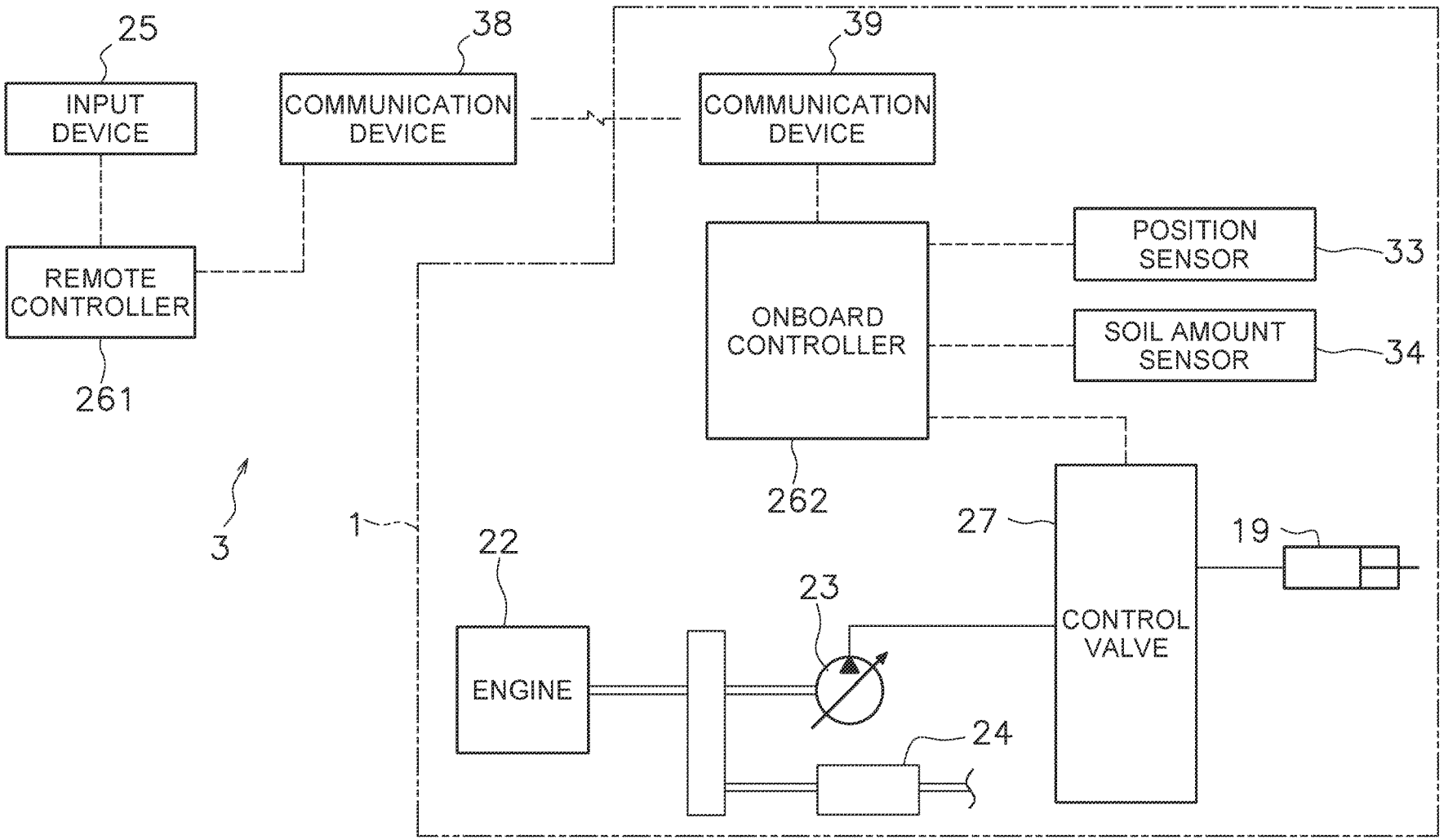
FIG. 8 is a block diagram showing the structure of the control system according to another embodiment.

The work machine 1 may be a vehicle that can be remotely controlled. In that case, a part of the control system 3 may be disposed outside the work machine 1. For example, as illustrated in FIG. 8, the controller 26 may include a remote controller 261 and an onboard controller 262. The remote controller 261 may be disposed outside the work machine 1. For example, the remote controller 261 may be located in an external management center of the work machine 1. The onboard controller 262 may be mounted on the work machine 1. The input device 25 may be disposed outside the work machine 1. The input device 25 may be omitted from work machine 1. In that case, the cab may be omitted from work machine 1.

The remote controller 261 and the onboard controller 262 may be configured to communicate wirelessly via the communication devices 38 and 39. Then, a part of the functions of the controller 26 described above may be executed by the remote controller 261 and the remaining functions may be executed by the onboard controller 262. For example, the process of determining the target trajectory may be executed by the remote controller 261. The process of outputting the command signal to the work implement 13 may be executed by the onboard controller 262.

The automatic control process is not limited to that of the above-described embodiment, and may be changed, omitted, or added. The execution order of the automatic control processing is not limited to that of the above-described embodiment, and may be changed.

According to the present disclosure, in the automatic control of the work machine, it is possible to suppress a decrease in work efficiency due to a factor, such as soil hardness.

The invention claimed is:

1. A system for controlling a work machine including a work implement, the system comprising:

a controller configured to acquire a position of an excavation end by the work machine, a target soil amount, and an excavation distance, determine a target excavation depth of a first pass based on the position of the excavation end, the target soil amount, and the excavation distance, move the work implement to the target excavation depth of the first pass to execute an excavation of the first pass, acquire an actual soil amount excavated in the first pass, modify the target soil amount based on the actual soil amount, determine the target excavation depth of a second pass based on the modified target soil amount, and move the work implement to the target excavation depth of the second pass to execute the excavation of the second pass.

2. The system according to claim 1, wherein the controller is further configured to acquire an angle of an approach path, and determine the target excavation depth of the first pass based on the position of the excavation end, the target soil amount, the excavation distance, and the angle of the approach path.

3. The system according to claim 2, wherein the controller is further configured to acquire an angle of an exit path, and determine the target excavation depth of the first pass based on the position of the excavation end, the target soil amount, the excavation distance, the angle of the approach path, and the angle of the exit path.

4. The system according to claim 3, wherein the controller is further configured to determine a target trajectory of the first pass based on the position of the excavation end, the excavation distance, the angle of the approach path, the angle of the exit path, and the target excavation depth of the first pass, and control the work implement to move according to the target trajectory of the first pass in the excavation of the first pass.

5. The system according to claim 1, wherein the controller is further configured to acquire a retreat distance indicative of a distance from an excavation start position of a previous pass to the excavation start position of a next pass, or a distance from the position of the excavation end to the excavation start position of the first pass, and determine the target excavation depth of the second pass based on the modified target soil amount and the retreat distance.

6. The system according to claim 5, wherein the controller is further configured to acquire an angle of an approach path, and determine the target excavation depth of the second pass based on the modified target soil amount, the retreat distance, and the angle of the approach path.

7. The system according to claim 1, wherein the controller is further configured to acquire a retreat distance indicative of a distance from an excavation start position of a previous pass to the excavation start position of a next pass, or a distance from the position of the excavation end to the excavation start position of the first pass, acquire a lower limit value of the target excavation depth, determine the target excavation depth of the next pass based on the modified target soil amount and the retreat distance until the target excavation depth reaches the lower limit value, and modify the retreat distance based on the modified target soil amount after the target excavation depth reaches the lower limit value.

8. A method performed by a controller for controlling a work machine including a work implement, the method comprising:

acquiring a position of an excavation end by the work machine, a target soil amount, and an excavation distance;

determining a target excavation depth of a first pass based on the position of the excavation end, the target soil amount, and the excavation distance;

executing an excavation of the first pass by moving the work implement to the target excavation depth of the first pass;

acquiring an actual soil amount excavated in the first pass;

modifying the target soil amount based on the actual soil amount;

determining the target excavation depth of a second pass based on the modified target soil amount; and executing the excavation of the second pass by moving the work implement to the target excavation depth of the second pass.

9. The method according to claim 8, further comprising:

acquiring an angle of an approach path; and determining the target excavation depth of the first pass based on the position of the excavation end, the target soil amount, the excavation distance, and the angle of the approach path.

10. The method according to claim 9, further comprising:

acquiring an angle of an exit path; and determining the target excavation depth of the first pass based on the position of the excavation end, the target soil amount, the excavation distance, the angle of the approach path, and the angle of the exit path.

11. The method according to claim 10, further comprising:

determining a target trajectory of the first pass based on the position of the excavation end, the excavation distance, the angle of the approach path, the angle of the exit path, and the target excavation depth of the first pass; and controlling the work implement to move according to the target trajectory of the first pass in the excavation of the first pass.

12. The method according to claim 8, further comprising:

acquiring a retreat distance indicative of a distance from an excavation start position of a previous pass to the excavation start position of a next pass, or a distance from the position of the excavation end to the excavation start position of the first pass, and determining the target excavation depth of the second pass based on the modified target soil amount and the retreat distance.

13. The method according to claim 12, further comprising:

acquiring an angle of an approach path; and determining the target excavation depth of the second pass based on the modified target soil amount, the retreat distance, and the angle of the approach path.

14. The method according to claim 8, further comprising:

acquiring a retreat distance indicative of a distance from an excavation start position of a previous pass to the excavation start position of a next pass, or a distance from the position of the excavation end to the excavation start position of the first pass;

acquiring a lower limit value of the target excavation depth;

determining the target excavation depth of the next pass based on the modified target soil amount and the retreat distance until the target excavation depth reaches the lower limit value; and modifying the retreat distance based on the modified target soil amount after the target excavation depth reaches the lower limit value.

15. A system for controlling a work machine including a work implement, the system comprising:

a controller configured to acquire a position of an excavation end by the work machine, a target soil amount, and an excavation distance, determine a target excavation depth of a pass based on the position of the excavation end, the target soil amount, and the excavation distance, and move the work implement to the target excavation depth of the pass to execute an excavation of the pass.

* * * * *